US009121232B2

(12) United States Patent
Abraham et al.

(10) Patent No.: US 9,121,232 B2
(45) Date of Patent: Sep. 1, 2015

(54) HYDRO-MECHANICAL DOWNHOLE TOOL

(75) Inventors: Aju Abraham, Houston, TX (US); Taylor Latham, Corpus Christi, TX (US)

(73) Assignee: Smith International, Inc., Houston, TX (US)

( * ) Notice: Subject to any disclaimer, the term of this patent is extended or adjusted under 35 U.S.C. 154(b) by 339 days.

(21) Appl. No.: 13/413,828

(22) Filed: Mar. 7, 2012

(65) Prior Publication Data

US 2012/0285703 A1 Nov. 15, 2012

Related U.S. Application Data

(60) Provisional application No. 61/452,568, filed on Mar. 14, 2011.

(51) Int. Cl.
*E21B 17/06* (2006.01)
*E21B 23/00* (2006.01)

(52) U.S. Cl.
CPC ..... *E21B 17/06* (2013.01); *E21B 23/00* (2013.01)

(58) Field of Classification Search
CPC ..... E21B 23/00; E21B 23/03; E21B 23/04; E21B 17/06
USPC ..... 166/382, 120, 377, 208, 381, 383
See application file for complete search history.

(56) References Cited

U.S. PATENT DOCUMENTS

| | | | |
|---|---|---|---|
| 4,757,860 | A | 7/1988 | Reimert |
| 5,472,055 | A | 12/1995 | Simson et al. |
| 5,884,702 | A | 3/1999 | Yokley et al. |
| 6,009,943 | A | 1/2000 | Yokley et al. |
| 7,114,573 | B2 | 10/2006 | Hirth |
| 7,225,880 | B2 | 6/2007 | Braddick |
| 7,373,988 | B2 | 5/2008 | Campbell et al. |
| 7,699,113 | B2 | 4/2010 | Ring |
| 2005/0051342 | A1 | 3/2005 | Campbell et al. |
| 2008/0257560 | A1 | 10/2008 | Brisco |
| 2011/0247832 | A1 | 10/2011 | Harris |

FOREIGN PATENT DOCUMENTS

| | | |
|---|---|---|
| EP | 1600600 | 11/2005 |

OTHER PUBLICATIONS

International Search Report and Written Opinion mailed on Nov. 1, 2012 for International Patent Application No. PCT/US2012/028896, 11 pages.

*Primary Examiner* — Yong-Suk (Philip) Ro
(74) *Attorney, Agent, or Firm* — Michael Stonebrook

(57) ABSTRACT

A downhole tool includes a body supported from a running string; and a releasing assembly for releasing from set liner hanger portions of the tool to be retrieved to the surface. The releasing assembly includes a connecting member for engaging the tool with a liner hanger, a piston hydraulically moveable in response to fluid pressure within the tool body from a lock position to a release position for releasing the connecting member, and a clutch for rotationally releasing the tool body from the liner hanger. Rotation of the running string moves a nut upward along the body so that the running string may then be picked up to disengage the tool from the liner hanger.

16 Claims, 5 Drawing Sheets

HYDRO-MECHANICAL DOWNHOLE TOOL

CROSS REFERENCE TO RELATED APPLICATIONS

This application claims the benefit of a related U.S. Provisional Application Ser. No. 61/452,568, filed Mar. 14, 2011, the disclosure of which is incorporated by reference herein in its entirety.

BACKGROUND

Typically, in the drilling of a well, a borehole is drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. Generally, this is repeated until a plurality of concentric casings are suspended and cemented within the well to a depth which causes the well to extend through one or more hydrocarbon producing formations.

Oftentimes, rather than suspending a concentric casing from the bottom of the borehole to the surface, a liner may be hung either adjacent the lower end of a previously suspended and cemented casing, or from a previously suspended and cemented liner. A liner hanger is used to suspend the liner within the lower end of the previously set casing or liner. A setting tool disposed on the lower end of a work string is releasably connected to the liner hanger that is coupled with the top of the liner. The liner hanger, liner, setting tool, and other components are generally part of a liner hanger assembly.

Another component, such as a liner top packer, may also be part of the liner hanger assembly, which may be used to seal the liner in the event of a poor cement job or to prevent gas flow while the cement sets. Typically, the liner top packer is set down on top of the liner hanger, and the liner top packer is set by the setting tool to seal the annulus between the liner and the previously set casing or liner. Liner top packers run with liner hangers typically include a tubular member with a bore in it that is coupled with the top end of the packer.

This tubular member is commonly referred to as a polished bore receptacle ("PBR") or a tieback receptacle ("TBR"). Because the liner does not run to the surface, the liner hanger has the ability to receive the PBR or TBR to connect the liner with a string of casing that extends from the liner hanger back to the surface. There is typically a seal or seal stack between the PBR and the body of the packer that allows axial motion of the PBR relative to the liner top packer body. A standard seal stack includes a plurality of annular spaced seals that fit within the interior of the PBR. Often, a PBR is coupled into an upper end of the packer, and production tubing is strung into the PBR with an appropriate seal to prevent leakage between the interior of the PBR and the production tubing.

Various types of liner hangers have been proposed for hanging a liner from a casing string in a well. Most liner hangers are set with slips activated by the liner hanger running tool. Liner hangers with multiple parts pose a significant liability when one or more of the parts become loose in the well, thereby disrupting the setting operation and making retrieval difficult. In addition, wellbores often have tight spots and dog legs through which the liner hanger maneuvers, increasing the risk of the liner hanger becoming stuck or coming apart. Other liner hangers and running tools cannot perform conventional cementing operations through the running tool before setting the liner hanger in the well.

Other liner hangers have problems supporting heavy liners with the weight of one million pounds or more. Some liner hangers successfully support the liner weight, but do no reliably seal with the casing string. After the liner hanger is set in the well, high fluid pressure in the annulus between the liner and the casing may blow by the liner hanger, thereby defeating its primary purpose.

Another significant problem with some liner hangers is that the running tool cannot be reliably disengaged from the set liner hanger. This problem with liner hanger technology concerns the desirability to rotate the liner with the work string in the well, then disengage from the work string when the liner hanger has been set to retrieve the running tool from the well. Prior art tools have disengaged from the liner hanger by right-hand rotation of the work string, although some operators for certain applications prefer to avoid right-hand rotation of a work string to release the tool from the set liner. In addition, operators are presented with the problem of debris entering the running tool during disengagement of the liner.

Accordingly, there exists a need for an improved downhole tool that has improved torque to wash and ream through tight spots and dog legs within the wellbore, that may avoid presetting while running, and that is able to more effectively maneuver through tight areas in the wellbore.

SUMMARY

In one aspect, the embodiments disclosed herein relate to a downhole tool that contains a body supported from a running string; and a releasing assembly for releasing from set liner hanger portions of the tool to be retrieved to the surface. The releasing assembly contains a connecting member for engaging the tool with a liner hanger, a piston hydraulically moveable in response to fluid pressure within the tool body from a lock position to a release position for releasing the connecting member, and a clutch for rotationally releasing the tool body from the liner hanger. The rotation of the running string moves a nut upward along the body so that the running string may then be picked up to disengage the tool from the liner hanger.

In another aspect, embodiments disclosed herein relate to a method of releasing a running tool while supported on a running string from a liner hanger in a casing within a wellbore. The liner hanger is secured to a casing by a slip assembly to suspend the liner hanger from the casing. The method includes providing a releasing assembly about a tool body, wherein the releasing assembly includes a connecting member for engaging the running string with the liner hanger, a piston hydraulically moveable in response to fluid pressure within the tool body from a lock position to a release position for releasing the connecting member, a clutch for rotationally connecting the tool body with the liner hanger; and pressurizing the running string to move the piston to the release position for releasing the running string.

In another aspect, embodiments disclosed herein relate to a method of setting a downhole tool. The method includes running the downhole to a desired depth in a wellbore; setting a liner hanger; activating hydraulically a setting tool; and compressing the setting tool. The compressing releases the setting tool from a liner.

Other aspects and advantages of embodiments of the invention will be apparent from the following description and the appended claims.

DETAILED DESCRIPTION

In some aspects, embodiments disclosed herein relate to downhole tools. In some aspects, embodiments disclosed herein relate to downhole tools having a packer or a packer and liner hanger. In certain aspects, embodiments disclosed herein relate to downhole tools having a packer, liner hanger, and setting adaptor.

In some aspects, embodiments disclosed herein relate to downhole tools having improved torque to run liner downhole. In certain aspects, embodiments disclosed herein relate to downhole tools having improved reliability for release of a setting adaptor.

In some aspects, embodiments disclosed herein relate to hydro-mechanical downhole tools. In some aspects, embodiments disclosed herein relate to downhole tools having mechanical mechanisms to set a liner and a hydraulic lock to release a setting tool.

In other aspects, embodiments disclosed herein relate to methods and apparatus for drilling and completing well bores. More specifically, embodiments disclosed herein relate to methods and apparatus for running liners downhole. In certain aspects, embodiments disclosed herein relate to methods and apparatus for hanging and/or setting liners in a wellbore.

Embodiments disclosed herein are described below with terms designating orientation in reference to a vertical wellbore. These terms designating orientation should not be deemed to limit the scope of the disclosure. For example, embodiments of the disclosure may be with reference to a non-vertical wellbore, such as a horizontal or lateral wellbore. It is to be further understood that the various embodiments described herein may be used in various orientations, such as inclined, inverted, horizontal, vertical, etc., and in other environments, such as sub-sea wells, without departing from the scope of the present disclosure. The embodiments are described merely as examples of useful applications, which are not limited to any specific details of the embodiments herein.

In addition, other directional terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction into the Earth from the surface (i.e., into the wellbore), but is meant for illustrative purposes only, and the terms are not meant to limit the disclosure.

To hang a liner, a downhole tool may initially be attached to the lower end of a work string and releasably connected to the liner top packer/setting adapter, from which the liner is suspended for lowering into the wellbore beneath the previously set casing or liner. The liner top packer/setting adapter may include, but is not limited to, a packer, liner, or setting adapter. The assembly may be run downhole at a rate that does not adversely affect the well formations or the downhole tool.

Figure 1A:
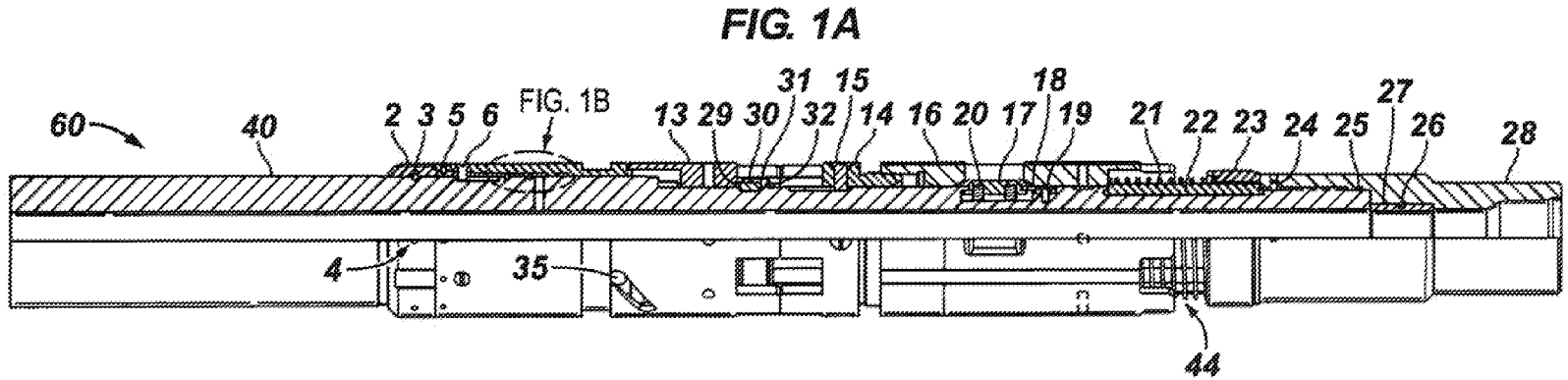
FIG. 1A shows a downhole tool in accordance with embodiments disclosed herein.

Referring to FIG. 1A, a downhole tool in accordance with embodiments described herein is shown. Embodiments of a downhole tool 60 disclosed herein may include a body 40 interfacing with hydraulic and mechanical components. In some embodiments, body 40, which may include a mandrel or other tubular, is used to transmit torque to other components of tool 60. In some embodiments, a downhole tool 60 may include a packer (not shown) as described in U.S. Pat. No. 4,757,860.

Downhole tool 60 may include a shearing means having a gage ring 2 interfacing with a lock ring 3, a set screw 4, a shear screw 5, and a key screw 6. The gage ring 2 may provide a larger diameter surface than the body 1 to prevent snagging or catching of components of the downhole tool 60 on downhole surfaces as the downhole tool 60 is lowered into the wellbore. The gage ring 2 may be disposed above or below the lock ring 3. Lock ring 3 may be used during compression to hold the gage ring 2 in place.

In some embodiments, the downhole tool 60 may include a hydraulically actuated release mechanism, operable in conjunction with a right-hand rotation of body 40, for releasing the downhole tool 60 from a liner top packer/setting adapter (not shown). In certain embodiments, the hydraulically actuated release mechanism may include a shear screw 5, which may be configured to be sheared at a pre-determined amount of shearing force, as would be known by a person having ordinary skill in the art. For example, the shearing force may be in the range of 5 to 50 klbs (kilopounds). In some embodiments, the shear screw 5 may be configured to shear upon a shearing force in excess of 40 klbs. In other embodiments, the shear screw 5 may be configured to shear upon a shearing force in excess of 12 klbs.

Figure 1B:
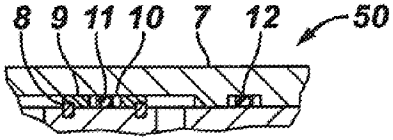
FIG. 1B shows a cylinder assembly in accordance with embodiments disclosed herein.

In some embodiments, the hydraulically actuated release mechanism may include a cylinder assembly 50. FIG. 1B illustrates a cylinder assembly 50 in accordance with embodiments described herein. In some embodiments, cylinder assembly 50 may be disposed laterally through body 40 or concentrically disposed within body 40. In certain embodiments, cylinder assembly 50 may include a hydraulic cylinder 7 interfacing with seal rings and o-rings, for example, seal split ring 8, seal ring 9, o-ring 11, o-ring backup 10, and o-ring 12. In some embodiments, seal rings may be formed of a material having substantial elasticity to span certain portions of body 40. In certain embodiments, the hydraulic cylinder 7 may include an actuator piston or ram (not shown) slidably engaged with body 40. In some embodiments, the shear screw 5 may be disposed laterally through the body 40, and engage the surface of body 40. In other embodiments, hydraulic cylinder 7 may be pressurized using a ball drop method, explained in detail below. In certain embodiments, premature release of the liner top packer/setting adapter may be prevented because torsion is stored in cylinder assembly 50 and is not transmitted to the running nut 23 until the hydraulic mechanism is activated. In other words, cylinder assembly 50 may act to prevent premature release of liner top packer/setting adapter from downhole tool 60.

Figure 1C:
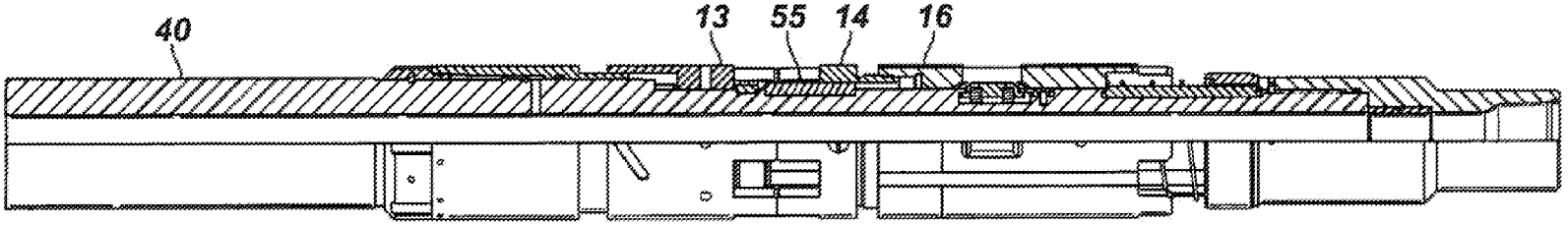
FIG. 1C shows a downhole tool in accordance with embodiments disclosed herein.

Returning to the exemplary downhole tool illustrated in FIG. 1A, in some embodiments, a top clutch 13 may interface with washer 29, stop ring 30, cover ring 31, external ring 32, key screw 15, middle clutch 14, and bottom clutch 16, to lock one or more dogs. In some embodiments, the one or more dogs may include a torque dog spring 20, a torque dog 17, a torque dog clamp 18, and a capscrew 19, which may act in conjunction to engage torque dog 17. In certain embodiments, the one or more dogs may be concentrically contained within an outer cylindrical housing. In some embodiments, top clutch 13, middle clutch 14, and bottom clutch 16 may each rotatably lock torque dog 17 such that rotation of body 40 results in the movement of one or more downhole components. Thus, the disposition of top clutch 13, middle clutch 14, and bottom clutch 16 convert the rotational movement of body 40 to a reciprocated motion and effectively function as a cam. In alternate embodiments, cover ring 31 and external ring 32 may not be required. For example, referring briefly to FIG. 1C, downhole tool 60 includes a key 55 disposed between top clutch 13 and middle clutch 14.

In certain embodiments, movement of body 40 may allow running nut 23 to move upward along right-hand threads due to right-hand rotation. In some embodiments, the internal flow path/bypass of running nut 23 may advantageously allow for debris to be removed from the interior space of a section 44 as the running nut 23 is threaded and/or unthreaded. Once the running nut 23 is unthreaded, the downhole tool 60 may be moved toward the wellbore surface to disengage the downhole tool 60 from the liner top packer/setting adapter.

In some embodiments, downhole tool 60 may energize torque dog 17 using a spring assembly 21 in conjunction with key 22, which interface with running nut 23, set screw 24, O-rings 25 and 26, standing valve profile 27, and bottom sub 28. In some embodiments, the spring assembly 21 and key 22 may act to transfer torque to running nut 23. In certain embodiments, exterior threads of running nut 23 may attach to a liner top packer/setting adapter (not shown) such that downhole tool 60 is attached to the liner top packer/setting adapter.

In some embodiments, components of downhole tool 60 may permit the operator to achieve an improved torque while running downhole tool 60 down the wellbore and/or setting the liner top packer/setting adapter. The improved torque may allow for higher compression and improved mitigation of tight spots and dog legs within the wellbore. In certain embodiments, downhole tool 60 may achieve a torque in the range of 25,000 to 75,000 foot pounds (ft/lb) of force. In certain embodiments, downhole tool 60 may achieve a torque in excess of 25,000 ft/lb, or in excess of 40,000 ft/lb, or in excess of 50,000 ft/lb of force.

Downhole tool 60 may also include other various design features such as various seals, washers, key screws and other various components to further facilitate the operation of the tool. In one embodiment, one or more pins 35 may be disposed on top clutch 13. In certain embodiments guides may be of various geometries, such as round, rectangular, square, etc. In certain embodiments, substantially square pins 35 may be used to reduce point contact.

Figure 2A:
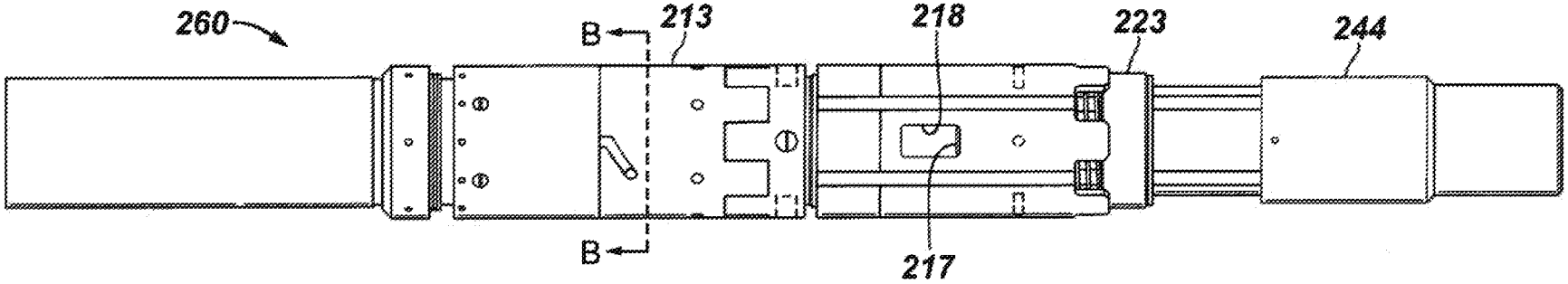
FIG. 2A shows a downhole tool in a first position in accordance with embodiments disclosed herein.

FIG. 2A shows a downhole tool in a first position in accordance with embodiments disclosed herein. In FIG. 2A, downhole tool 260 is ready to attach to a liner top packer/setting adapter (not shown). In some embodiments, top clutch 213 engages to compresses torque dog 217, which transmits a rotational force to portion 244, and more specifically, running nut 223. In exemplary embodiments, top clutch 213 may rotate to the left 30 degrees to disengage torque dog 217 and transmit the rotational force. In some exemplary embodiments, the rotational force causes running nut 223 to rotate four times to the left and connect the downhole tool 260 to the liner top packer/setting adapter.

Figure 2B:
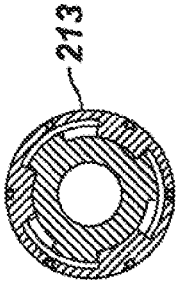
FIG. 2B shows a cross-sectional view of a downhole tool in a first, position in accordance with embodiments disclosed herein.

FIG. 2B shows a cross-sectional view of a downhole tool in a first position in accordance with embodiments disclosed herein. More specifically, FIG. 2B is a cross-sectional view taken through position B-B of downhole tool 260 prior to connection of the liner top packer/setting adapter. For example, FIG. 2B shows a view of the clutch assembly prior to the top clutch 213 being engaged to compress torque dog 217 and effectuate rotational movement of running nut 223. As illustrated in FIG. 2A, torque dog 217 is disengaged and not viewable through window 218.

Figure 3A:
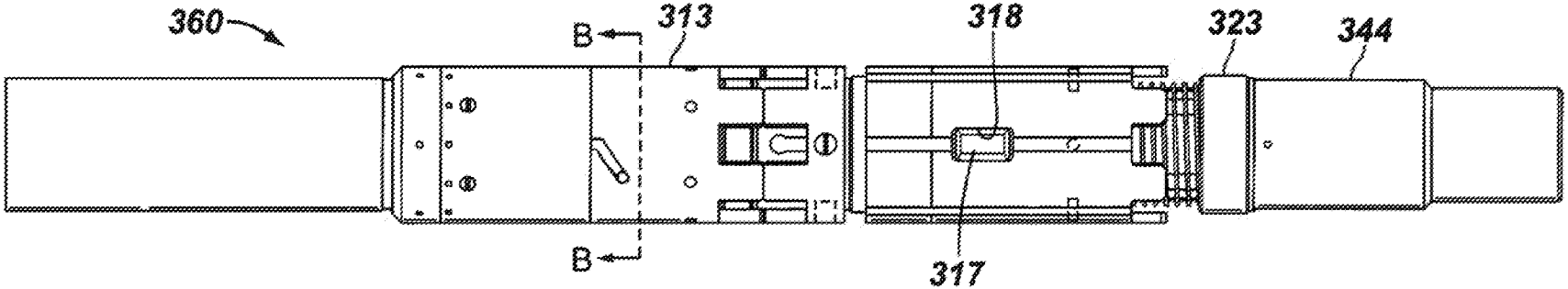
FIG. 3A shows a downhole tool in a second position in accordance with embodiments disclosed herein.

FIG. 3A shows a downhole tool in a second position in accordance with embodiments disclosed herein. In some embodiments, FIG. 3A shows downhole tool 360 after the liner top packer/setting adapter (not shown) is attached to downhole tool 360 such that downhole tool 360 is in a run in position. For example, top clutch 313 has been engaged and running nut 323 has rotated to attach the liner top packer/setting adapter to portion 344. Torque dog 317 is also engaged and viewable through window 318. In certain embodiments, the downhole tool 360 shown in FIG. 3A is run downhole and remains in the run in position until the desired wellbore depth is reached. In certain embodiments, the downhole tool 360 shown in FIG. 3A is prepared to place the liner top packer/setting adapter at a desired location downhole.

Figure 3B:
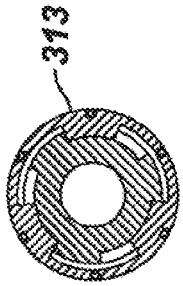
FIG. 3B shows a first cross-sectional view of a downhole tool in a second position in accordance with embodiments disclosed herein.

FIG. 3B shows a first cross-sectional view of a downhole tool in a second position in accordance with embodiments disclosed herein. More specifically, FIG. 3B is a cross-sectional view taken through position B-B of downhole tool 360 after connection of the liner top packer/setting adapter. In some embodiments, FIG. 3B shows the clutch assembly after top clutch 313 has been engaged and the liner top packer/setting adapter is attached.

Figure 4A:
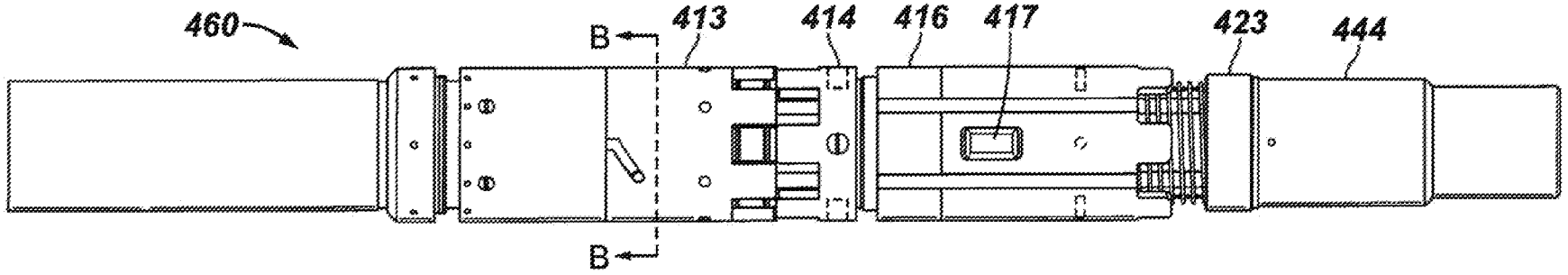
FIG. 4A shows a downhole tool in a third position in accordance with embodiments disclosed herein.

FIG. 4A shows a downhole tool in a third position in accordance with embodiments disclosed herein. In FIG. 4A, downhole tool 460 is set to an extended position to prepare to release the liner top packer/setting adapter (not shown). In some embodiments, middle clutch 414 is engaged, effectuating rotational movement of portion 444 and more specifically, running nut 423. An applied rotational force may thus cause running nut 423 to rotate to the right. In some embodiments, actuation of top clutch 413 prepares downhole tool 460 to be released from the liner top packer/setting adapter and subsequently pulled toward the surface of the wellbore (not shown). In certain embodiments, bottom clutch 416 cannot move because it is adjacent to the liner top packer/setting adapter.

Figure 4B:
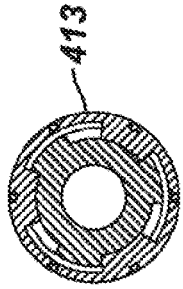
FIG. 4B shows a cross-sectional view of a downhole tool in a third position in accordance with embodiments disclosed herein.

FIG. 4B shows a cross-sectional view of a downhole tool in a third position in accordance with embodiments disclosed herein. More specifically, FIG. 4B is a cross-sectional view taken through position B-B of downhole tool 460. In some embodiments, FIG. 4B is a cross-sectional view of the clutch assembly after middle clutch 414 has been engaged. For example, FIG. 4B shows a view of the clutch assembly after the top clutch 413 has been engaged (and ready to compress torque dogs 417) to effectuate rotational movement of portion 444, and more specifically, running nut 423.

Figure 5:
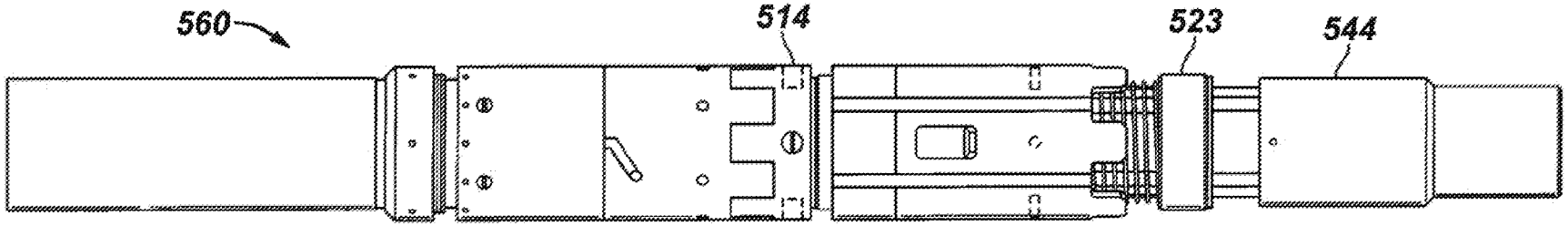
FIG. 5 shows a downhole tool in a fourth position in accordance with embodiments disclosed herein.

FIG. 5 shows a downhole tool in a fourth position in accordance with embodiments disclosed herein. In some embodiments in FIG. 5, liner top packer/setting adapter (not shown) is unthreaded in preparation to pull downhole tool 560 back to the wellbore surface. In certain embodiments, portion 544, and more specifically, running nut 523, is rotated to the right to disengage the liner top packer/setting adapter. In some embodiments, the rotation of running nut 523 releases downhole tool 560 from liner top packer/setting adapter and pulled back to the surface of the wellbore.

Figure 6:
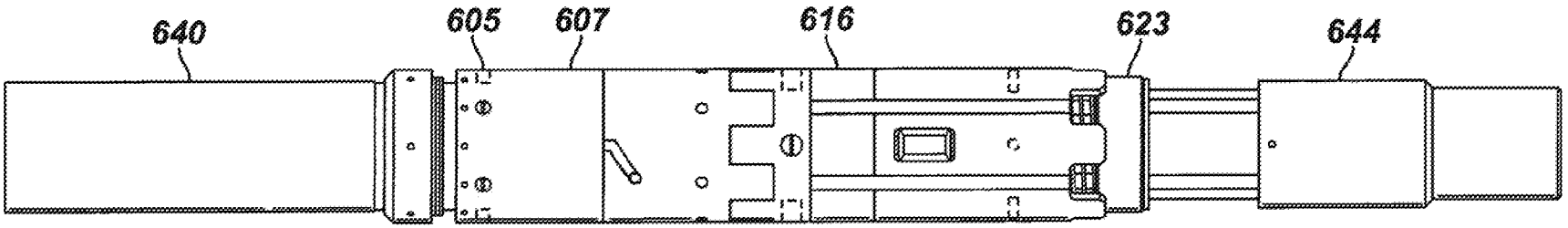
FIG. 6 shows a downhole tool in a fifth position in accordance with embodiments disclosed herein.

FIG. 6 shows a downhole tool in a fourth position in accordance with embodiments disclosed herein. In some embodiments in FIG. 6, a ball drop is performed to shear the shear screw 605 and ready downhole tool 660 to be rotationally disengaged from the liner top packer/setting adaptor and pulled back to the wellbore surface. In other embodiments, a ball drop is performed to shear the shear screw 605 and ready portion 644 to be released from the liner top packer/setting adapter by a rotational force on running nut 623. In certain embodiments, hydraulic cylinder 607 may be pressurized using a ball drop method. In some embodiments, a ball drop within body 640 may increase fluid pressure to the piston, as explained below. The fourth position is functionally between the first and second position, described above.

Different methods may be used to increase fluid pressure to actuate components of downhole tool 660. In one embodiment, a method may include performing a ball (not shown) drop, including but not limited to, collet fingers, a ball valve, and a mechanically expanding ball seat. For example, downhole tool 660 may use collet fingers (not shown) as a ball seat, such that an expansion of the collet fingers may allow the ball to drop through the expanded seat. As another example, a rotating ball valve may be used such that a small hole in the valve acts as a seat for the ball and an increase in pressure causes rotation of the ball, allowing the ball to drop. As a further example, a ball drop method may include dropping a ball (not shown) from handling equipment at the wellbore surface (not shown) into one or more seats (not shown) within downhole tool 660.

In some embodiments, as the ball moves through the downhole tool 660, it may cause fluid pressure to increase when seated. Upon application of pressure to the seated ball, one or more shear pins (for example, shear screw 605) may be sheared, thereby disengaging the downhole tool 660 from the liner top packer/setting adapter. In some embodiments, the shearing of the shear screw 605 and passage of fluid through the one or more ports may act upon one or more pistons (not shown) connected to top clutch 616 to disengage the torque dogs, thereby allowing transmission of rotational force to portion 644, rotating running nut 623 and thereby releasing the liner top packer/setting adapter. Once the shear screw 605 is sheared, the ball may then be moved into a ball diverter (not shown), allowing fluids to be circulated through the downhole tool 660, which is prepared for cementing steps.

In some embodiments, hydraulic cylinder 607 may be pressurized to apply force to an actuator piston (not shown). Once the force exceeds a pre-determined set point, the piston may axially move the upper body 640 in order to shear the shear screw 605.

Advantageously, embodiments disclosed herein provide for an improved ability to mitigate tight spots and dog legs within the wellbore. Said another way, embodiments disclosed herein may advantageously allow an improved ability to wash and ream in the wellbore due to improved torque. In addition, some embodiments may advantageously use a bearing for rotation of the liner top packer/setting adaptor.

Further advantages include the hydraulic mechanism of embodiments disclosed herein. Some embodiments disclosed herein may advantageously prevent premature release of the downhole tool by use of the hydraulic mechanism. Advantageously, in embodiments disclosed herein, the hydraulic mechanism may act as a hydraulic lock whereby premature release of the liner top packer/setting adaptor is prevented, thus providing improved reliability.

Advantageously, embodiments disclosed herein provide an internal, flow path of a running nut, thereby allowing removal of debris from internal components of the downhole tool as the running nut is threaded and/or unthreaded. Further advantages include the improved alignment of the downhole tool with the liner top packer/setting adaptor provided by engagement of the one or more dogs.

Also advantageously, embodiments of the present application may provide a timing feature, such that, for example, eight turns of the body starts rotation of a bottom clutch, while, for example, four turns may be effectuated to engage top and middle clutches. Those of ordinary skill in the art will appreciate that the number of rotations required to engage and disengage top, middle, and bottom clutches may vary in accordance with specific design requirements.

While embodiments of the invention have been described with respect to a limited number of embodiments, those skilled in the art, having benefit of this disclosure, will appreciate that other embodiments can be devised which do not depart from the scope of the embodiments as disclosed herein. Accordingly, the scope of embodiments of the invention should be limited only by the attached claims.

What is claimed:

1. A downhole tool comprising:

a body supported from a running string; and a releasing assembly for releasing from set liner hanger portions of the tool to be retrieved to the surface, the releasing assembly comprising a connecting member for engaging the tool with a liner hanger, a piston hydraulically moveable in response to fluid pressure within the tool body from a lock position to a release position for releasing the connecting member, and one or more clutches for rotationally releasing the tool body from the liner hanger, wherein rotation of the running string moves a nut upward along the body so that the running string is picked up to disengage the tool from the liner hanger.

2. The tool of claim 1, wherein the fluid pressure within the tool is adjusted by a ball drop.

3. The tool of claim 2, wherein the releasing assembly comprises a shearing device.

4. The tool of claim 3, wherein a pressure differential caused by the ball drop creates a force on the piston that exceeds a predetermined set point of the shearing device.

5. The tool of claim 1, further comprising a plurality of dogs.

6. The tool of claim 1, wherein the tool achieves a torque of at least 40,000 ft/lb when supported by the running string.

7. The tool of claim 1, the releasing assembly further comprising a shear screw.

8. The tool of claim 7, wherein the shear screw is configured to shear in a range between about 5 and about 50 kilopounds.

9. A downhole tool comprising:

a liner hanger body removably supportable on a running tool for positioning a liner downhole, the liner hanger body engaged with a casing string by the running tool; and a hydraulic mechanism on the running tool for releasing the running tool from the liner;

wherein the running tool comprises a plurality of clutches for releasing the liner hanger to secure the liner downhole; and wherein the hydraulic mechanism releases the liner from the running tool after the liner is secured.

10. A method of releasing a running tool while supported on a running string from a liner hanger in a casing within a wellbore, the liner hanger secured to a casing by a slip assembly to suspend the liner hanger from the casing, the method comprising:

providing a releasing assembly about a tool body, the releasing assembly including a connecting member for engaging the running string with the liner hanger, a piston hydraulically moveable in response to fluid pressure within the tool body from a lock position to a release position for releasing the connecting member, a plurality of clutches for rotationally connecting the tool body with the liner hanger; and pressurizing the running string to move the piston to the release position for releasing the running string.

11. The method of claim 10, further comprising passing cement through the liner when the liner hanger body is set to cement the liner in the well bore.

12. A method of setting a downhole tool, the method comprising:

running the downhole tool to a desired depth in a wellbore;

performing a wash and ream operation performed by the downhole tool during the running of the downhole tool to the desired depth in the wellbore;

setting a liner hanger;

activating hydraulically a setting tool, wherein the activating hydraulically comprises performing a ball drop; and compressing the setting tool, wherein the compressing releases the setting tool from a liner.

13. The method of claim 12, further comprising rotating the setting tool, wherein the rotating releases the setting tool from the liner.

14. The method of claim 13, wherein the rotating comprises rotating the setting tool at least 30 degrees.

15. The method of claim 12, further comprising rotating the liner during a cementation operation.

16. The method of claim 12, further comprising applying over 25,000 ft/lb of torque during the running the downhole tool to the desired depth in the wellbore.

* * * * *